US012644378B2

(12) United States Patent
Daniels et al.

(10) Patent No.: US 12,644,378 B2
(45) Date of Patent: Jun. 2, 2026

(54) MONITORING AND DETECTING SEAL INTEGRITY WITH TRACERS

(71) Applicant: Resman AS, Ranheim (NO)

(72) Inventors: John Daniels, Houston, TX (US); Olaf Kristoffer Huseby, Oslo (NO); Roy Greig, Aberdeen (GB); Sven Kristian Hartvig, Raelingen (NO); Douglas Alexander Pipchuk, Calgary (CA); Christopher N. Fredd, Centennial, CO (US)

(73) Assignee: Resman Technology AS, Trondheim (NO)

( * ) Notice: Subject to any disclaimer, the term of this patent is extended or adjusted under 35 U.S.C. 154(b) by 0 days.

(21) Appl. No.: 19/230,324

(22) Filed: Jun. 6, 2025

(65) Prior Publication Data

US 2025/0347218 A1 Nov. 13, 2025

Related U.S. Application Data

(63) Continuation of application No. PCT/US2024/042668, filed on Aug. 16, 2024.

(60) Provisional application No. 63/532,938, filed on Aug. 16, 2023.

(51) Int. Cl.
*E21B 33/12* (2006.01)
*E21B 47/11* (2012.01)

(52) U.S. Cl.
CPC ..... *E21B 47/11* (2020.05); *E21B 33/12* (2013.01); *E21B 2200/08* (2020.05)

(58) Field of Classification Search
CPC ..... E21B 47/11; E21B 33/12; E21B 2200/08
See application file for complete search history.

(56) References Cited

U.S. PATENT DOCUMENTS

| | | | | |
|---|---|---|---|---|
| 5,413,179 | A | 5/1995 | Scott, III | |
| 6,035,701 | A | 3/2000 | Lowry et al. | |
| 11,697,755 | B2 * | 7/2023 | Gao | E21B 21/08 166/250.12 |
| 2010/0223988 | A1 | 9/2010 | Crow et al. | |
| 2011/0277996 | A1 * | 11/2011 | Cullick | E21B 43/16 166/250.12 |
| 2014/0239164 | A1 | 8/2014 | Rothrock et al. | |
| 2017/0285219 | A1 | 10/2017 | Brady et al. | |
| 2017/0328191 | A1 * | 11/2017 | Wessling | E21B 49/003 |
| 2018/0179886 | A1 | 6/2018 | Espe et al. | |
| 2018/0298277 | A1 * | 10/2018 | Borrell | E21B 47/11 |
| 2019/0100973 | A1 * | 4/2019 | Lauritzen | E21B 23/01 |
| 2019/0323342 | A1 * | 10/2019 | Pedersen | G01M 3/20 |
| 2019/0345821 | A1 | 11/2019 | Farley et al. | |
| 2020/0032641 | A1 * | 1/2020 | Kulyakhtin | E21B 43/14 |
| 2022/0091026 | A1 | 3/2022 | Scott et al. | |

FOREIGN PATENT DOCUMENTS

WO WO-2024218368 A1 * 10/2024 ..... F24T 10/30

OTHER PUBLICATIONS

Matos, Taina, ISR for PCT/US2024/042668, Dec. 26, 2024, WIPO, Alexandria, VA.
Matos, Taina, WO for PCT/US2024/042668, Dec. 26, 2024, WIPO, Alexandria, VA.
Dyrli, A.D., et al., Ten Years of Reservoir Monitoring with Chemical Inflow Tracers—What Have We Learnt and Applied over the Past Decade?, Oct. 2017, PE-187677-MS, Society of Professional Engineers, Alexandria, VA article also presented at the SPE Kuwait Oil & Gas Show and Conference in Kuwait City, Kuwait, Oct. 15-18, 2017.

* cited by examiner

*Primary Examiner* — Silvana C Runyan
(74) *Attorney, Agent, or Firm* — Kearney, McWilliams & Davis; Erik J. Osterrieder

(57) ABSTRACT

Methods and systems are provided for monitoring a tracer within a monitored system that includes at least three barrier layers and at least three corresponding tracers. The barrier layers—referred to as a first, second, and third barrier layer—may each have an initial association with a different one of the three tracers. The methods and systems may further enable detection, such as after the monitoring step, of a tracer at a location outside its initial associated barrier layer, where the detected tracer may be one of the three tracers. In certain embodiments, additional barrier layers and/or additional tracers may be employed, and interactions between and/or among them may allow determination of the location, concentration, amount, and identity of one or more traced compositions, including, for example, identification of breaches, within sealable monitored systems.

24 Claims, 1 Drawing Sheet

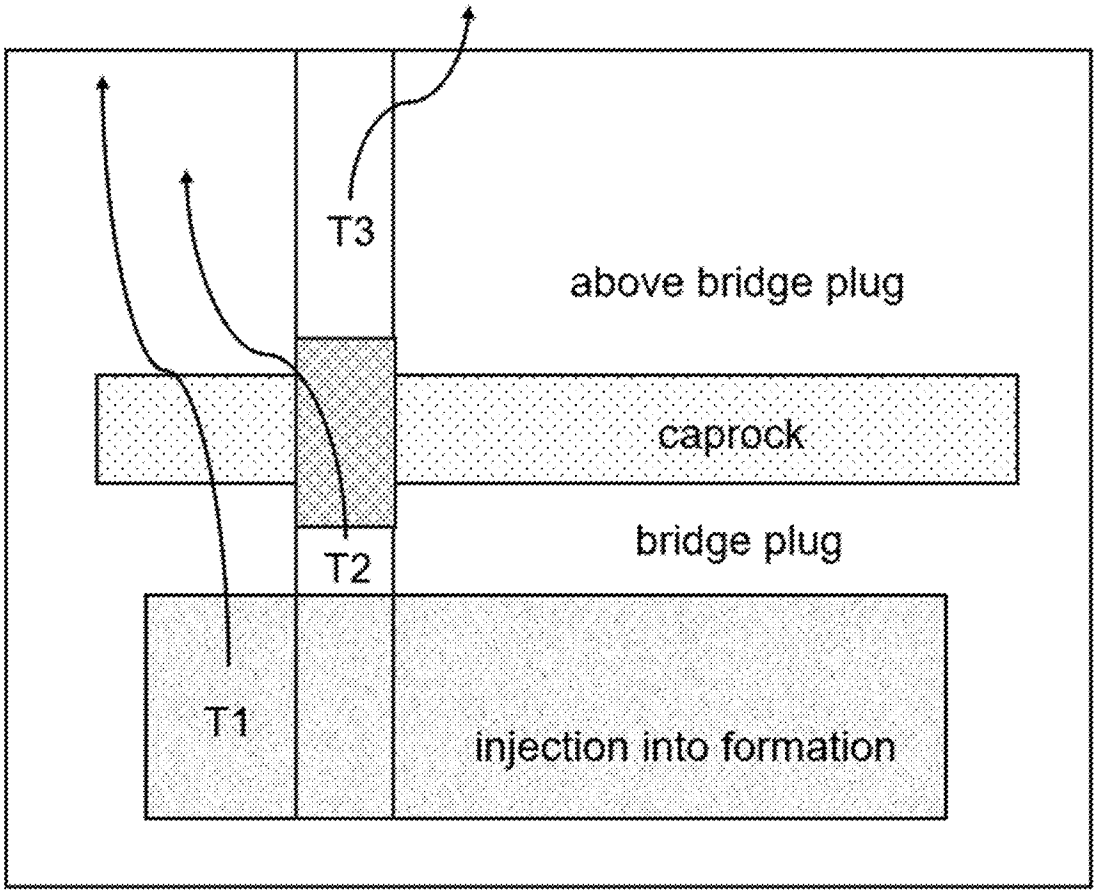
above bridge plug
caprock
bridge plug
injection into formation
T3
T2
T1

MONITORING AND DETECTING SEAL INTEGRITY WITH TRACERS

REFERENCE TO RELATED APPLICATION

This is a continuation application from and that claims priority to PCT application PCT/US2024/042668 filed Aug. 16, 2024, which claims priority to U.S. provisional application No. 63/532,938 filed on 16 Aug. 2023, each of which is incorporated by this reference.

FIELD

This disclosure relates to methods and systems for monitoring, such as through tracers and sensors, and determining breach(es) and flow pattern(s) of one or more compositions from one or more zone(s) as function(s) of concentration, quantity, volume, time, otherwise or combinations thereof.

BACKGROUND

Plugging and abandoning ("P&A") operations of wellbores are a standard operation in oil and gas. A typical operation, for example, may require isolating a zone of interest from the wellbore by pumping fluids into the reservoir, typically a plug, e.g., cast iron bridge plug, which sets above the zone of interest to stop any communication between the zone of interest and wellbore. Furthermore, a cement plug may set above the bridge plug, as a secondary barrier for potential leak paths, to ensure or improve sealing. If a wellbore still has pressure-containment issues, then a squeeze perforation and cement job may be performed to help to plug up, set, and ensure sealing between the zone of interest and the wellbore. Thereafter, operators abandon these wells after removing surface hardware.

There are many technical problems with P&A, containment, and monitoring operations, which may be improved or removed, such as by those disclosed throughout this disclosure, that utilize tracer(s) and detector(s) as part of the solution(s). Additionally and alternatively, with long-term integrity playing such a critical role given the nature of current carbon capture, utilization, and sequestration ("CCUS") projects, a monitoring technique with the ability to indicate cap rock integrity and leak compliance is critical to improve assurance that reservoirs are suitable for long-term storage of components.

SUMMARY

In example embodiments, disclosed are methods and systems for monitoring a tracer in a monitored system having at least three barrier layers and at least three tracers, wherein for the at least three barrier layers those barrier layers may be called a first barrier layer, a second barrier layer, and a third barrier layer, wherein each of these barrier layers has an initial association with a different one of the three tracers. Further, the disclosed methods and systems may detect, subsequent to the monitoring, the tracer at a location that is external to the initial association for the different one of the three tracers, wherein the tracer is one of the three tracers.

BRIEF DESCRIPTION OF THE DRAWING

So that the manner in which the above recited features, advantages and objects of the present disclosure are attained and can be understood in detail, a more particular description of this disclosure, briefly summarized above, may be had by reference to an example embodiment thereof that is illustrated in the appended drawing.

It is to be noted, however, that the appended drawing illustrates only typical embodiments of this disclosure and is therefore not to be considered limiting of its scope, for this disclosure may admit to other equally effective embodiments.

FIG. 1 depicts a monitored system having three barrier layers and a different tracer in each of those three barrier layers in accordance with this disclosure although the monitored system may have more than three barrier layers, more than three different tracers, more than three tracers, where some may be duplicates, and/or otherwise other example embodiments of the monitored system for detecting tracer(s), determining tracer flow paths, concentration of traced compounds, and other methods performed in sealable systems for possible detection of breaches therein.

DETAILED DESCRIPTION

Below, directional terms, such as "above," "below," "upper," "lower," "front," "back," "top," "bottom," etc., are used for convenience in referring to the accompanying drawings. In general, "above," "upper," "upward," "top," and similar terms refer to a direction towards the earth's surface, and "below," "lower," "downward," "bottom," and similar terms refer to a direction away from the earth's surface, but is meant for illustrative purposes only, and the terms are not meant to limit the disclosure.

Various specific embodiments, versions and examples are described now, including exemplary embodiments and definitions that are adopted herein for purposes of understanding. While the following detailed description gives specific preferred embodiments, those skilled in the art will appreciate that these embodiments are exemplary only, and that the disclosure can be practiced in other ways. For purposes of determining infringement, the scope of the invention will refer to the claims, including their equivalents, and elements or limitations that are equivalent.

Generally disclosed are methods and systems for monitoring, such as through tracers and sensors, and determining breach(es) and flow pattern(s) of one or more compositions from one or more zone(s) as function(s) of concentration, quantity, volume, time, otherwise or combinations thereof. To illustrate the disclosed apparatuses, methods, and systems, the following discussion centers around employing one or more tracers in caprock integrity monitoring in applications such as plug-and-abandonment ("P&A") operations, enhanced oil recovery operations (EOR) operations, or carbon capture and storage (CCS) operations to permit or enhance the ability of operators to monitor potential and actual breaches in the integrity of zonal isolation, such as in a cementitious zone or caprock, wherein the monitored breakthrough composition may be any gas, liquid, or solid, and in one example embodiment, is carbon dioxide. The disclosed apparatuses, methods, and systems are not limited to P&A, EOR, or CCS applications, but, instead, may be used in any well, portion thereof, or any isolated container, reservoir, or system, even one other than a well, where one would like to monitor the long-term integrity of a seal and escaping pathways of one or more of its components and/or contaminants entering into and/or having entered into the monitored zone. Throughout this disclosure, it is understood that "P&A" or a "P&A operation" means a barrier installation operation between at least two zones of interest, whereby the well could be used to monitor at least one of its zones in the future. Furthermore, the disclosed apparatuses, methods, and systems are also applicable for monitoring zones or intervals isolated behind a production string in production or injection wells. An example embodiment is transient testing of the caprock seal by introducing an integrity-proving stage into workflow.

P&A operations of wellbores are a standard operation in oil and gas. A typical operation, for example, may require isolating a zone of interest from the wellbore by pumping fluids into the reservoir, typically a plug, e.g., cast iron bridge plug, which sets above the zone of interest to stop any communication between the zone of interest and wellbore. Furthermore, a cement plug may set above the bridge plug, as a secondary barrier for potential leak paths, to ensure or improve sealing. If a wellbore still has pressure-containment issues, then a squeeze perforation and cement job may be performed to help to plug up, set, and ensure sealing between the zone of interest and the wellbore. Thereafter, operators abandon these wells after removing surface hardware.

Turning towards further details of the disclosed apparatuses, methods, and systems, tracers may be integrated into various oil and gas operations, such as P&A operations, whether on-shore or off-shore. After a pressure test, there is little feedback if a plug has integrity. Even if a plug holds during a P&A operation, how long the plug will hold is indeterminate. Utilizing tracer technology, one may better monitor the long-term effectiveness of a plug.

Many hardware components used in P&A operations work well in standard oilfield operations, including, without limitation, shifts from primary recovery to enhanced oil recovery ("EOR") operations and carbon capture and storage ("CCS") operations. The conditions to which these P&A operations interventions are exposed may exceed the capacity of the state of the art. For example, periodic injection and production (i.e., huff and puff) operations may cause cyclic loading against such seals, and as such, these P&A techniques may not have long-term integrity. The injection of carbon dioxide into a reservoir may cause excessive corrosion, which could again compromise the integrity of scaling solutions. With long-term integrity playing such a critical role given the nature of current CCU projects, the need for monitoring and detecting apparatuses, methods, and systems with the ability to indicate cap pock integrity and leak compliance are needed for assurance that reservoirs are suitable for long-term storage of components.

In various example embodiments, the disclosed apparatuses, methods, and systems may include using tracer(s) in workover fluid(s), which may be injected into reservoir(s) prior to, during, or after a P&A operation. In one example embodiment, a traced fluid may be pumped ahead of a workover operation, and this traced fluid containing Tracer 1 ("T1" in FIG. 1) is located in the near wellbore region. If a plug were to give up its pressure and sealing integrity, one or more monitoring and/or detecting sources could locate and/or follow paths of T1, and the operator would have more information as to the source of the leak emanating from the near wellbore region.

In additional example embodiments, addition of a tracer, optionally in combination with one or more additives, whether the additive(s) are added with or separately from an injection fluid, may provide desirable properties such as chemical and/or physical healing mechanism(s) and/or solutions to the leak, containment, or other desired treatments to the reservoir, wherein such additives are called "healing agents." For example, if an operator was concerned with saline water breakthrough, a healing agent, whether chemical and/or physical, that would increase viscosity or self-heal may be added to this fluid, whether before, simultaneously, or after introduction of the tracer, or to the fluid that would activate upon an undesired set of conditions. By further example, types of additives for adding to this fluid, with the tracer, or added separately to the reservoir, zone, plug, cement, and/or other component of an oil or gas operation, but are not limited to, opacifiers, pigments, colorants, anti-corrosive agents, buffers, pH adjusting agents, antioxidants, fillers, gas-barrier/blocking additives, latex, gas scavengers, polymers, solvents, precipitating agents, generated ceramics (e.g., in-situ-generated ceramics), emulsifiers, descalers, viscosifiers, inhibiters, catalysts, rheological modifiers, weighting agents, chemical agents, physical agents, other additive(s) or combinations thereof. A tracer, itself, may be oil, water, gas, or any other type of tracer, or combinations of tracer types thereof, desired for injecting to monitor and detect a traced composition in the reservoir.

In another example embodiment, a fluid injected at, near, or remote to the wellhead and into the reservoir may include a doping agent as an additive. For example, this example embodiment may include doping a $CaCl_2$ salt solution, carbonic anhydrase, or another doping agent or doped solution, with the workover fluid containing T1 for plugged-and-abandoned wells in a CCS project area. This disclosed apparatus, methods, and system enable tracing of fluid containing T1 beginning from its injection point or simply from any configurably decided starting point in the reservoir now containing T1 to leaked locations, including in the near wellbore ("NWB") region of the wellbore. Monitoring for and detecting of the presence of T1 may be seen in one or more collected samples from the wellbore. The $CaCl_2$ salt solution (or other solution (e.g., [Group I or II]+[Group VII or polyatomic ion] compound) that permits an ion-exchange-and-precipitate reaction), when mixed with gaseous carbon dioxide from reservoir injection(s), would form a precipitate, i.e., $CaCO_3$ in the NWB region of the reservoir, thereby reducing or even ceasing the mobility of carbon dioxide in that region. Formation of the precipitate may decrease or completely inhibit any further flow or leak of carbon dioxide. In both example cases presented in the preceding two paragraphs, monitoring for the presence of the T1 and seeing it decrease with time, an operator may gain insight and/or assurance that reservoir integrity was improving over time.

In further example embodiments and referring again to FIG. 1, a Tracer 2 ("T2") may be introduced to the wellbore. T2 may be located in one or more locations, e.g., hung, attached, slipped into a pocket, slot, or other compartment, otherwise, or combinations thereof, below the bridge plug or packer, which provides wellbore isolation. In other example embodiments, T2 may be located in one or more locations, such as integrated into, i.e., part of the chemical composition of, the bridge plug, and/or a dissolvable section upon contact with any or a particular gas, liquid or solid. Alternatively, T2 could be deployed by a variety of mechanisms such as spotted in solution, in a viscous fluid, or in a polymer matrix.

Summarizing and extending on the foregoing, in this disclosure, one or more barrier layers, e.g., a P&A well section milled above a kill-well with a series of cement plugs in an off-shore application, may be tagged with one or more type(s) of tracers (that may include additive(s), such as but not limited to those previously disclosed additives) disposed under one or more sections and into the reservoir (i.e., as opposed to only being directly under a plug, but directly under a plug(s) may be used alternatively or additionally), and monitored to determine flows, i.e., leak paths, of compositional leaks in one or more these zones as function of concentration, quantity, volume, time, otherwise or combinations thereof. As a result, different types of tracers at different points can assist greatly in detecting, such as through use of one or more detectors known in the art and located in optionally removable location(s), the location and leak path of traced compositions, wherein the compositions being traced may be the same or different, and/or emanate come from the same or different zone. And, the addition of one or more additives may slow or even prevent one or more leaks, which may be monitored and traced as discussed herein. In further example embodiments, the tracer and/or additive(s) may be introduced, e.g., injected, into (i.e., not just above and/or below a section) the plug, into the cement (i.e., as opposed to the wellbore), into bridge plugs, into melted metals, into rock formation, into melted rock formation, and/or portions of the wellbore where seal integrity and/or leak flow is tracer-monitored. An injection of tracer, and optionally additives, including self-healing agents as discussed herein, may occur, for instance, after removal of casing created during a P&A operation or simultaneously during placement of casing during a P&A operation.

Turning to tracers in the apparatuses, methods, and systems, the tracers may be inert or chemically react with traced composition(s) or component(s) thereof in the same or different phase. The tracers may be radioactive, e.g., radioactive isotope of calcium composition, or may be non-radioactive, such as chemical tracers. Although non-limiting, examples of chemical tracers for use for use in the disclosed apparatuses, methods, and systems include those discussed in U.S. Pat. Nos. 10,030,507, 8,603,827, 7,560,690, 7,347,260 and/or otherwise. For instance, the tracers for use may be intelligent tracers, tracers designed from one or more polymers, tracers capable of leaving a unique fingerprint, gas and water tracers, specific chemical and/or phase tracers, and so forth. Embodiments may include different detection limits in that one or more may trace at parts per million, parts per billion, parts per trillion, parts per quadrillion, etc. or combinations thereof in the reservoir. And, in addition to the other discussion herein, the tracers that are injected into other wells in the field, such as one or more injectors in EOR, CCS, or other oil and gas operations, may be mixed or dispersed, whether before, during or after injection, in any phase into cement, cast iron, molten metal, solutions, or any component or solution used in oil and gas operations.

Monitoring, detecting, determining, and calculating in the disclosed methods and systems, are performed through use of one or more monitors, detectors, and other tools, each of which are associated with enabling logic reduced to hardware and/or software known and/or within the ken of the skilled artisans, may be located in optionally removable remote and/or local location(s) to the system having the barrier layers and tracer(s) moving therethrough. Monitoring, detecting, determining, and calculating of the traced composition(s), tracers, additives, reaction products, contaminants, and/or otherwise may occur at various locations, including, but not limited to subsea, subterranean, and/or at the surface, whether water or soil. Thus, soil detection of traced composition(s) is possible for the disclosed methods and systems.

In various example embodiments, the apparatuses, methods, and systems, the wellbore plugging mechanism is designed to withstand multiple pressure and stress cycles as well as corrosive issues often experienced, for example, with standard cast-iron bridge plugs, which are used today. As a result and for some operations, the disclosed apparatuses, methods, and systems, may use a composite (e.g., non-metallic and/or non-corrosive) plug made for long-term use. In areas where long-term integrity is crucial, the apparatuses, methods, and systems may use other chemical forms, such as resins and/or melted metals, may be more feasible for shut off. And, yet additional example embodiments to improve seal, diminish flows caused by leak(s), or stop leak(s) may include adding, e.g., injecting, latex additives, such as for gas blocking and/or using one or more swelling agents, which swell in the presence of compositions, such as water. Any or all combinations of the foregoing, may be injected and/or placed in the disclosed methods and systems before, simultaneously, or subsequent to the addition of a tracer solution.

Returning to FIG. 1, disclosed are example embodiments of apparatuses, methods, and systems that include addition of Tracer 3 ("T3") by integrating it into the cement, which sets above the plug in at least one location in the NWB region above a zone of interest. Alternatively and additionally, T3 and/or other tracer(s) could be deployed above and/or below the plug by a variety of mechanisms such as hung, attached, slipped into a pocket, slot, or other compartment, otherwise, spotted above the plug in solution, in a viscous fluid, or in a polymer matrix, or combinations thereof. And, although not depicted in FIG. 1, additional tracer(s), such as T4, T5, T6, T7, etc. may be added to injected fluids in one or more reservoirs, optionally in communication with the reservoir in FIG. 1 and/or offset well(s). Additionally and alternatively, more than one tracer may be injected into the same zone(s), such as in cases where the desire is to trace, and optionally quantify, particular components of a fluid within one or more zones. In such cases, the tracer and/or additive(s) discriminate in allowing for tracing, monitoring, and quantifying at least one component apart from the remaining components in or from the zonal fluid.

Understanding the presence or absence of any combination of the different tracers provides information on the integrity of the zonal isolation, the wellbore plug, the caprock in the vicinity of the well, and much more. Furthermore, this information may be used by operators, for instance, to ensure that their well has integrity, which may need proof in order for operators to claim carbon capture credits.

This disclosed apparatuses, methods, and systems are also beneficial in EOR reservoirs. In the future, these reservoirs may be a storage location for captured carbon dioxide if suitable. The disclosed tracer technology is a way to provide an operator with peace of mind for long-term wellbore integrity, the ability to prove the same, and safe use of these assets.

Attention turns now to another example and non-limiting embodiment of the disclosed apparatuses, methods, and systems that further discusses inventive aspects of location, types of tracers, and number of tracers. A P&A well, which includes the above-disclosed tracer technology and illustrated in FIG. 1, is installed in a well within the boundaries of a CCS project. Tracers T1, T2, and T3 are three distinct carbon dioxide tracers in this example, but in other examples could be for tracing other compositions. Depending on the tracer response, the following scenarios may be differentiated in this T1, T2, and T3 carbon-dioxide tracers example:

1) No tracers observed in soil or wellbore monitors: indicates integrity of system at this well location.
2) T2 and T3 observed on wellbore monitors, no T2 or T1 observed on soil monitors: indicates that the plug has lost viability 3) T2 is observed on soil monitors, no T1 or T3: indicates that the plug has lost integrity and the casing has a leak
4) T1 observed on soil monitors, no T2 or T3: indicates a leak through the caprock, while the plug maintains integrity. Furthermore, if a chemical-healing technology was included in the workover fluid in the formation, then a decline in T1 over time provides positive indication that the chemical healing mechanism is reducing the carbon dioxide mobility around the well.

By analogy, the monitored location and detected presence of tracers in this disclosure may be thought of as a traffic light, wherein green is sealed or go, yellow is compromised seal integrity, and red is more compromised seal integrity than yellow or even complete loss of seal integrity, all of which is revealed by the monitored location and detected presence of tracer(s), e.g., monitoring and detecting each of T1, T2, and T3 as a function of concentration and/or time.

During the process of caprock integrity evaluation in the P&A operation, carbon capture, utilization, and sequestration ("CCUS") pre-assessment well with the tracer technology, if no tracers are observed in soil or wellbore monitors, then this indicates integrity of system at this well location. A method may include:

1) tracer(s) is/are deployed below the barrier and has/have optional connectivity installed to the reservoir, to the layer installed below the barrier, and/or otherwise;
2) barrier is installed across caprock;
3) connection is made to annulus and geology above caprock barrier; and
4) observe for tracer migrating from below barrier.

Yet further example embodiments of methods and systems are provided in the subsequent paragraphs on monitored systems having at least one seal, whose integrity may be monitored through the disclosed inventions using tracer(s). In various example embodiments, disclosed is a method that may include monitoring a tracer in a monitored system comprising three barrier layers and three tracers, wherein the three barrier layers comprise a first barrier layer, a second barrier layer, and a third barrier layer, wherein each of the three barrier layers has an initial association with a different one of the three tracers. Further the method may include detecting, subsequent to the monitoring, the tracer at a location that is external to the initial association for the different one of the three tracers, wherein the tracer is one of the three tracers. In other example embodiments, the methods may include more than three barrier layers, more than three tracers, and/or wherein all or at least three of the tracers are different from one another.

In further example embodiments, the method in the preceding paragraph may further include collecting, subsequent to the monitoring, one or more samples from the monitored system, and/or collecting, subsequent to the detecting, at least the tracer.

In further example embodiments, the method in either of the preceding two paragraphs may further include iterating the monitoring, over a time period, the tracer in the monitored system, and that iteration may include monitoring at least the tracer in the monitored system but may include monitoring other tracers, compositions, and/or other substances in the monitored system.

In further example embodiments, the method in any of the preceding three paragraphs may include introducing, such as by injecting and/or pumping, any or all the tracers into the monitored system. That is, for example, the method may include pumping at least one the three tracers into the monitored system.

In further example embodiments, the method in any of the preceding four paragraphs may include introducing at least one of the three tracers into a plug in the monitored system. Such introducing may include integrating the tracer, and optionally additives, into the plug, attaching the tracer to the plug as further discussed earlier in this disclosure, and/or otherwise affixing or adjoining any or all of the tracers in one or more plugs located in the monitored system.

In further example embodiments, the method in any of the preceding five paragraphs may include introducing at least one of the three tracers into the plug in the monitored system, wherein the plug is at least partially dissolvable to release at least a portion of the tracer into the monitored system.

In further example embodiments, the method in any of the preceding six paragraphs may include introducing one or more additives into the plug in the monitored system, wherein the plug is at least partially dissolvable to release at least a portion of one of the one or more additives into the monitored system.

In further example embodiments, the method in any of the preceding seven paragraphs may include introducing at least one of the three tracers into a reservoir, which is located above a plug, which is located within the monitored system. Additionally and alternatively, the method may include introducing at least one of the three tracers into a reservoir, which is located below a plug, which is located within the monitored system.

In further example embodiments, the method in any of the preceding eight paragraphs may include introducing the three tracers and at least one doping agent into the monitored system, wherein the at least one doping agent at least reduces mobility of carbon dioxide in the monitored system and/or affects mobility of a contaminant by formation of a precipitate by the introducing of the doping agent in the monitored system.

In further example embodiments, the method in any of the preceding nine paragraphs may include introducing: (i) the three tracers and at least one swelling agent into the monitored system; (ii) the three tracers and at least one healing agent into the monitored system; (iii) the three tracers and at least one additive into the monitored system; (iv) a latex additive into the monitored system; (v) simultaneously, at least one doping agent with at least one of the three tracers into the monitored system; (vi) simultaneously, at least one additive with at least one of the three tracers into the monitored system; (vii) simultaneously, at least one healing agent with at least one of the three tracers into the monitored system; (viii) simultaneously, a doping agent in each of the three tracers into the monitored system; (ix) simultaneously, at least one healing agent with each of the three tracers into the monitored system; and/or (x) simultaneously, at least one additive with each of the three tracers into the monitored system.

In further example embodiments, the method in any of the preceding ten paragraphs may include determining, based on the detecting, a flow pattern of the tracer(s), concentration of traced compounds, and/or a breach(es) and/or the breach location(s) in the monitored system.

In further example embodiments, the method in any of the preceding ten paragraphs may include detecting tracer(s) in location(s) that is/are external and/or internal to the monitored system, wherein such detected tracer(s) is/are in location(s) different from the initial association(s).

In further example embodiments, the method in any of the preceding eleven paragraphs may include the monitored system having more than three barrier layers and/or more than three tracers. Additionally and alternatively, at least one barrier layer of the more than three barrier layers may include at least two tracers, wherein the at least two tracers are different from any other tracer in the monitored system. Additionally and alternatively, at least one barrier layer of the more than three barrier layers may include at least two tracers, wherein one of the at least two tracers is different from any other tracer in the monitored system. Additionally and alternatively, at least one barrier layer of the more than three barrier layers may include at least two tracers, wherein one or more of the at least two tracers are identical to other tracer(s) in the monitored system.

In further example embodiments, the method in any of the preceding twelve paragraphs may include detecting at a location above caprock, and wherein portion(s) of the monitored system are located above and/or below the caprock.

In further example embodiments, the method in any of the preceding thirteen paragraphs may include determining an identity/identities of traced composition(s), wherein a traced composition includes the tracer and composition(s), wherein a traced composition may be chemically and/or physically changed by the disclosed methods and systems. For such determining, digital, analog, and/or mechanical tools possessing enabling logic reduced to hardware and/or software, known in the industry and/or within the skilled artisan's ken (e.g., collectively, "a determining tool"), are used in the disclosed methods and systems, whereby the determining may include determining a concentration, amount, flow paths, etc. of the traced composition(s), whether determined in situ and/or after partial or complete collection from the monitored system. Additionally, the method may include determining a "carbon offset" and/or a "carbon credit," terms understood in the industry, from the traced composition(s).

To enable the disclosed methods' and systems' monitoring, detecting, calculating, determining, introducing, collecting, and other functions, tools, whether digital, analog, and/or mechanical coupled with enabling logic reduced to hardware and/or software and/or having functionality that are known to the skilled artisan or within the skilled artisan's ken are used.

Now, further example embodiments of systems are provided in the subsequent paragraphs on monitored systems having at least one seal, whose integrity may be monitored through the disclosed inventions using tracer(s). In various example embodiments, disclosed is a system, which may include at least one monitor for monitoring a tracer in a monitored system comprising three barrier layers and three tracers, wherein the three barrier layers comprise a first barrier layer, a second barrier layer, and a third barrier layer, wherein each of the three barrier layers has an initial association with a different one of the three tracers. Further, the system may include at least one detector for detecting the tracer at a location that is external to the initial association for the different one of the three tracers, wherein the tracer is one of the three tracers.

In further example embodiments, the monitored system in the preceding paragraph may be or include a well, a portion of a well, an isolated container, a reservoir, other system having a potential of escaping pathways, or combinations thereof. Additionally and alternatively, the monitored system may be or include a scalable monitored system, wherein one or more seals for barrier layers in the sealable monitored system are non-metal or all seals for barrier layers in the scalable monitored system are non-metal.

In further example embodiments, the system in the preceding two paragraphs may further include a collector for collecting: (i) one or more samples from the monitored system; and/or (ii) at least the tracer, which may include a traced composition.

In further example embodiments, the system in any of the preceding three paragraphs may further include at least one input location in the monitored system for introduction of the three tracers into the monitored system.

In further example embodiments, the system in any of the preceding four paragraphs may further include at least one pump, optionally removably connected to the system, for pumping at least one the three tracers into the monitored system.

In further example embodiments, the system in any of the preceding five paragraphs may further include one or more plugs in the monitored system.

In further example embodiments, the system in any of the preceding six paragraphs may further include at least one input location, located on or in communication with monitored system, for introducing at least one of the three tracers into the one or more plugs.

In further example embodiments, the system in any of the preceding seven paragraphs may include the tracer being integrated into the one or more plugs.

In further example embodiments, the system in any of the preceding eight paragraphs may include at least one swelling agent being integrated into the one or more plugs.

In further example embodiments, the system in any of the preceding nine paragraphs may include at least one, at least two, or all of the tracers in the monitored system being integrated into one or more plugs.

In further example embodiments, the system in any of the preceding ten paragraphs may include one or more additives and the tracer in the monitored system being integrated into at least one of the one or more plugs.

In further example embodiments, the system in any of the preceding eleven paragraphs may include one or more doping agents and the tracer in the monitored system being integrated into at least one of the one or more plugs.

In further example embodiments, the system in any of the preceding twelve paragraphs may include one or more healing agents and the tracer in the monitored system being integrated into at least one of the one or more plugs.

In further example embodiments, the system in any of the preceding thirteen paragraphs may include one or more healing agents, one or more doping agents, the tracer, and optionally one or more other additives, in the monitored system being integrated into at least one of the one or more plugs.

In further example embodiments, the system in any of the preceding fourteen paragraphs may include two or more tracers and one or more additives in the monitored system being integrated into one or more of the one or more plugs.

In further example embodiments, the system in any of the preceding fifteen paragraphs may include one or more plugs being at least partially dissolvable to release at least a portion of the tracer, and optionally additives, into the monitored system.

In further example embodiments, the system in any of the preceding sixteen paragraphs may further include at least one input location for introducing at least one of the three tracers into a reservoir, which is located below a plug and within the monitored system.

In further example embodiments, the system in any of the preceding sixteen paragraphs may further include a collector for removing, from the monitored system, a precipitate formed by a doping agent in the monitored system.

In further example embodiments, the system in any of the preceding seventeen paragraphs may further include a determining tool for determining: (i) a flow path, concentration, amount, identity, etc. of the tracer, wherein the tracer may include the traced composition; and/or (ii) a breach in the monitored system.

In further example embodiments, the detector in the system in any of the preceding eighteen paragraphs, may include detecting the tracer in a location that is within the monitored system, external to the monitored system, and/or different from the initial association.

In further example embodiments, the monitored system in any of the preceding nineteen paragraphs, may include more than three barrier layers and/or more than three tracers. Further examples include: (i) wherein at least one barrier layer of the more than three barrier layers comprises at least two tracers, wherein the at least two tracers are different from any other tracer in the monitored system; (ii) wherein at least one barrier layer of the more than three barrier layers comprises at least two tracers, wherein one of the at least two tracers is different from any other tracer in the monitored system; and/or (iii) wherein at least one barrier layer of the more than three barrier layers comprises at least two tracers, wherein one or more of the at least two tracers are identical to other tracer(s) in the monitored system.

In further example embodiments, the detector in any of the preceding twenty paragraphs, may include detecting comprises at a location above caprock. Additionally and alternatively, the detector may include detecting at a location above caprock, and wherein the monitored system is below the caprock.

In further example embodiments, the tracer in any of the preceding twenty-one paragraphs, may be: (i) radioactive; (ii) in solid phase; (iii) in liquid phase; (iv) in gas phase; (v) combined with a carrier gas; and/or (vi) combined with a carrier liquid.

In further example embodiments, the system in any of the preceding twenty-two paragraphs may further include at least one input location for introducing: (i) a latex additive and/or any other additive, optionally integrated into the one or more plugs, into the monitored system; (ii) at least one swelling agent, optionally integrated into the one or more plugs, into the monitored system; (iii) at least one input location for introducing a doping agent, optionally integrated into the one or more plugs, into the monitored system. The doping agent may at least reduce mobility of carbon dioxide, and/or other traced and captured composition, in the monitored system, wherein reduced, possibly to the point of elimination, may result from precipitating out of solution or other physical or chemical change that may permit collection, removal, and/or sequestration for containment. Collection, removal, and/or sequestration for containment may be desirable for contaminant(s) in the system or monitored system and/or ultimately obtaining carbon offsets and/or carbon credits.

In further example embodiments, the determining tool in any of the preceding twenty-three paragraphs may include determining: (i) an identity of the traced composition, which may include a removable tracer after separation therefrom, (ii) a concentration and/or amount of the traced composition; and/or (iii) a carbon offset and/or a carbon credit from the traced composition.

While the foregoing is directed to example embodiments of the disclosed invention, other and further embodiments may be devised without departing from the basic scope thereof, wherein the scope of the disclosed apparatuses, methods and systems are determined by one or more claims.

What is claimed is:

1. A method comprising:

monitoring a tracer in a monitored system comprising three barrier layers and three tracers, wherein the three barrier layers comprise a first barrier layer, a second barrier layer, and a third barrier layer, wherein each of the three barrier layers has an initial association with a different one of the three tracers; and detecting, subsequent to the monitoring, the tracer at a location that is external to the initial association for the different one of the three tracers, wherein the tracer is one of the three tracers.

2. The method of claim 1, further comprising introducing at least one of the three tracers into a plug in the monitored system.

3. The method of claim 2, further comprising introducing one or more additives into the plug in the monitored system, wherein the plug is at least partially dissolvable to release at least a portion of one of the one or more additives into the monitored system.

4. The method of claim 1, further comprising introducing at least one of the three tracers into a reservoir above a plug and within the monitored system.

5. The method of claim 1, further comprising introducing at least one of the three tracers into a reservoir, which is located below a plug and within the monitored system.

6. The method of claim 1, further comprising introducing the three tracers and at least one doping agent into the monitored system.

7. The method of claim 6, wherein the at least one doping agent at least reduces mobility of carbon dioxide in the monitored system.

8. The method of claim 7, further comprising effecting mobility of a contaminant by formation of a precipitate by the introducing of the doping agent in the monitored system.

9. The method of claim 1, further comprising introducing the three tracers and at least one swelling agent into the monitored system.

10. The method of claim 1, further comprising introducing the three tracers and at least one healing agent into the monitored system.

11. The method of claim 1, further comprising introducing a latex additive into the monitored system.

12. The method of claim 1, further comprising determining, based on the detecting, a flow pattern of the tracer.

13. The method of claim 1, further comprising determining, based on the detecting, a breach in the monitored system.

14. The method of claim 1, wherein the detecting comprises detecting the tracer in a location that is external to the monitored system.

15. The method of claim 1, wherein the detecting comprises detecting the tracer in a location that is within the monitored system.

16. The method of claim 1, further comprising the monitored system having more than three barrier layers and/or more than three tracers, wherein at least one barrier layer of the more than three barrier layers comprises at least two tracers, wherein the at least two tracers are different from any other tracer in the monitored system.

17. The method of claim 1, further comprising the monitored system having more than three barrier layers and/or more than three tracers, wherein at least one barrier layer of the more than three barrier layers comprises at least two tracers, wherein one of the at least two tracers is different from any other tracer in the monitored system.

18. The method of claim 1, further comprising the monitored system having more than three barrier layers and/or more than three tracers, wherein at least one barrier layer of the more than three barrier layers comprises at least two tracers, wherein one or more of the at least two tracers are identical to other tracer(s) in the monitored system.

19. The method of claim 1, wherein the detecting comprises at a location above caprock.

20. The method of claim 1, wherein the detecting comprises at a location above caprock, and wherein the monitored system is below the caprock.

21. The method of claim 1, further comprising determining a concentration and/or amount of a traced composition traced by the tracer.

22. The method of claim 1, further comprising determining a carbon offset and/or a carbon credit from a traced composition traced by the traced.

23. The method of claim 1, wherein the monitored system further comprises a doping agent.

24. A system comprising:

at least one monitor for monitoring a tracer in a monitored system comprising three barrier layers and three tracers, wherein the three barrier layers comprise a first barrier layer, a second barrier layer, and a third barrier layer, wherein each of the three barrier layers has an initial association with a different one of the three tracers; and at least one detector for detecting the tracer at a location that is external to the initial association for the different one of the three tracers, wherein the tracer is one of the three tracers.

* * * * *